US011661852B2

(12) United States Patent
LoRicco et al.

(10) Patent No.: US 11,661,852 B2
(45) Date of Patent: May 30, 2023

(54) TURBINE BLADE TRAILING EDGE COOLING FEED

(71) Applicant: Raytheon Technologies Corporation, Farmington, CT (US)

(72) Inventors: Nicholas M. LoRicco, Agawam, MA (US); Parth Jariwala, Cambridge, MA (US); Alex J. Schneider, South Glastonbury, CT (US); Bret M. Teller, Meriden, CT (US); Matthew S. Gleiner, Redondo Beach, CA (US); Jeffrey T. Morton, Manchester, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 17/429,097

(22) PCT Filed: Feb. 7, 2020

(86) PCT No.: PCT/US2020/017174
§ 371 (c)(1),
(2) Date: Aug. 6, 2021

(87) PCT Pub. No.: WO2020/167598
PCT Pub. Date: Aug. 20, 2020

(65) Prior Publication Data

US 2022/0098988 A1 Mar. 31, 2022

Related U.S. Application Data

(60) Provisional application No. 62/802,987, filed on Feb. 8, 2019.

(51) Int. Cl.
*F01D 5/18* (2006.01)
*F01D 5/08* (2006.01)

(52) U.S. Cl.
CPC ..... *F01D 5/187* (2013.01); *F01D 5/087* (2013.01); *F05D 2240/304* (2013.01);
(Continued)

(58) Field of Classification Search
CPC .... F01D 5/187; F01D 5/087; F05D 2240/304; F05D 2250/711; F05D 2250/712; F05D 2260/201
See application file for complete search history.

(56) References Cited

U.S. PATENT DOCUMENTS 5,403,159 A 4/1995 Green et al.
7,452,186 B2 11/2008 Charbonneau et al.
(Continued)

FOREIGN PATENT DOCUMENTS

EP 1952911 A1 8/2008
EP 2189230 A1 5/2010
(Continued)

OTHER PUBLICATIONS

International Search Report and Written Opinion dated Jul. 23, 2020 for PCT/US2020/017174.

*Primary Examiner* — Courtney D Heinle
*Assistant Examiner* — Ryan C Clark
(74) *Attorney, Agent, or Firm* — Bachman & LaPointe, P.C.

(57) ABSTRACT

A turbine blade has an attachment root and an airfoil. A cooling passageway system has a plurality of trunks extending from respective inlets along the root inner diameter end from a leading trunk near a first axial end to a trailing trunk near a second axial end; and a plurality of outlets along the airfoil including trailing edge outlets fed by the trailing trunk. Viewed normal to a root end-to-end centerplane: the trailing trunk has a turn passing forward and then rearward;
(Continued)

an outside of the turn protrudes forward; and the outside of the turn has a tighter curvature than an inside of the turn.

21 Claims, 15 Drawing Sheets

(52) U.S. Cl.
CPC .. *F05D 2250/711* (2013.01); *F05D 2250/712* (2013.01); *F05D 2260/201* (2013.01)

(56) References Cited

U.S. PATENT DOCUMENTS

| | | | | |
|---|---|---|---|---|
| 7,806,658 | B2 | 10/2010 | Liang et al. | |
| 2013/0092340 | A1 * | 4/2013 | Dube | B22D 29/001 164/6 |
| 2017/0211396 | A1 * | 7/2017 | Mongillo | F01D 9/02 |
| 2017/0248021 | A1 * | 8/2017 | Auxier | F01D 9/041 |

FOREIGN PATENT DOCUMENTS

| | | | | |
|---|---|---|---|---|
| EP | 3211179 | A1 | 8/2017 | |
| EP | 3354850 | A1 * | 8/2018 | F01D 5/185 |
| WO | 03/042503 | A1 | 5/2003 | |

* cited by examiner

TURBINE BLADE TRAILING EDGE COOLING FEED

CROSS-REFERENCE TO RELATED APPLICATION

Benefit is claimed of U.S. Patent Application No. 62/802,987, filed Feb. 8, 2019, and entitled "Turbine Blade Trailing Edge Cooling Feed", the disclosure of which is incorporated by reference herein in its entirety as if set forth at length.

BACKGROUND

The disclosure relates to cooled blades for gas turbine engines. More particularly, the disclosure relates to construction of feed passageways for trailing edge cooling cavities.

In exemplary gas turbine engine cooled blades (e.g., of turbine sections) the blades are cooled by cooling air introduced to a cooling passageway system through inlets in the inner diameter (ID) end of a blade attachment root (e.g., a firtree or dovetail profile). Outlets are typically along the gaspath-contacting surface of the blade including along the airfoil and optionally along the outer diameter (OD) surface of the platform. Along the airfoil, cooling outlet locations include along the leading edge, along the pressure and/or suction sides, and along the trailing edge. A typical cooling passageway configuration has a trailing edge slot fed from a trailing edge cavity.

Exemplary feeding of the trailing edge cavity is from the rearmost or downstreammost cooling inlet in the root. A trunk passes radially outward from the inlet to the trailing edge cavity. Depending upon implementation, the trunk may pass directly to the cavity or may feed an uppass which, in turn, feeds the trailing edge cavity as a downpass.

Exemplary blade manufacturing techniques are investment casting techniques using ceramic cores to form the entirety or bulk of the cooling passageway system. Various methods use hybrid ceramic and refractory metal cores. An example of such a hybrid core involves a refractory metal sheet mated to a main ceramic feedcore with the refractory metal sheet ultimately casting the trailing edge discharge slot and a mating leg of the feedcore casting the trailing edge passageway/cavity that feeds the discharge slot. Additional refractory metal cores may be used at other locations along the airfoil. Furthermore, some cooling outlets may be drilled or machined (e.g., mechanically drilled or electrodischarge machined (EDM)).

In one exemplary baseline group of blades, the trailing edge passageway proceeds radially outward through a trunk section and then turns toward the trailing edge in the trailing edge cavity to feed the trailing edge outlets (e.g., via the discharge slot).

SUMMARY

One aspect of the disclosure involves a turbine blade comprising: an attachment root and an airfoil. The root has: an inner diameter end; a first axial end; a second axial end, a rearward direction defined from the first axial end to the second axial end; a first lateral side; and a second lateral side, an end-to-end centerplane between and extending parallel to the first and second lateral sides. The airfoil has: a pressure side; a suction side; a leading edge; and a trailing edge. A cooling passageway system comprises: a plurality of trunks extending from respective inlets along the root inner diameter end from a leading trunk near the first axial end to a trailing trunk near the second axial end; and a plurality of outlets along the airfoil including trailing edge outlets fed by the trailing trunk. Viewed normal to the end-to-end centerplane, the trailing trunk has a turn passing forward and then rearward.

A further embodiment of any of the foregoing embodiments may additionally and/or alternatively include, viewed normal to the end-to-end centerplane, an outside of the turn protruding forward.

A further embodiment of any of the foregoing embodiments may additionally and/or alternatively include, viewed normal to the end-to-end centerplane, the outside of the turn having a tighter curvature than an inside of the turn.

A further embodiment of any of the foregoing embodiments may additionally and/or alternatively include, the outside of the turn forming a first bump and the inside of the turn forming a second bump.

A further embodiment of any of the foregoing embodiments may additionally and/or alternatively include, a forward extreme of the second bump being radially outboard of a forward extreme of the first bump.

A further embodiment of any of the foregoing embodiments may additionally and/or alternatively include, viewed normal to the end-to-end centerplane, the outside of the turn protruding forward of an adjacent portion of the trunk by at least 10% of a span of the adjacent portion.

A further embodiment of any of the foregoing embodiments may additionally and/or alternatively include, viewed normal to the end-to-end centerplane, a leading side of the turn including the outside of the turn having a transition from inwardly convex to inwardly concave to inwardly convex.

A further embodiment of any of the foregoing embodiments may additionally and/or alternatively include, along the inwardly concave portion of the leading side of the turn, the leading side turning by an angle of 30° to 120°.

A further embodiment of any of the foregoing embodiments may additionally and/or alternatively include, along the inwardly convex portion of the leading side of the turn radially outboard of the inwardly concave portion, the leading side turning by an angle of 30° to 55°.

A further embodiment of any of the foregoing embodiments may additionally and/or alternatively include, a trailing side of the turn having an inwardly concave portion turning by an angle of 25° to 50° before an inwardly convex transition to a discharge slot.

A further embodiment of any of the foregoing embodiments may additionally and/or alternatively include, an angle $\theta_5$ between a stacking line and a tangent at the inflection point where the leading side begins to turn back forward being at least 15°.

A further embodiment of any of the foregoing embodiments may additionally and/or alternatively include, viewed normal to the end-to-end centerplane, an outside of the turn having a tighter curvature than an inside of the turn.

A further embodiment of any of the foregoing embodiments may additionally and/or alternatively include, viewed normal to the end-to-end centerplane, the trailing trunk turning radially nests with a next forward one of the trunks.

A further embodiment of any of the foregoing embodiments may additionally and/or alternatively include the next forward trunk feeding an uppass-downpass-uppass.

A further embodiment of any of the foregoing embodiments may additionally and/or alternatively include, viewed normal to the end-to-end centerplane, the trailing trunk turn radially nesting between the next forward one of the trunks and a turn from the downpass to the downstream uppass.

A further embodiment of any of the foregoing embodiments may additionally and/or alternatively include the next forward trunk feeding an uppass with which the turn nests.

A further embodiment of any of the foregoing embodiments may additionally and/or alternatively include a method for using the turbine blade, the method comprising: passing air in through the inlets and out the outlets, wherein: air passing along the turn avoids separation.

A further embodiment of any of the foregoing embodiments may additionally and/or alternatively include at a downstream end of the turn, the air fanning out.

A further embodiment of any of the foregoing embodiments may additionally and/or alternatively include, at a downstream end of the turn, the air fanning out with a forward flowline turning by an angle of 15° to 60.

Another aspect of the disclosure involves a turbine blade comprising an attachment root and an airfoil. The root has: an inner diameter end; a first axial end; a second axial end, a rearward direction defined from the first axial end to the second axial end; a first lateral side; and a second lateral side, an end-to-end centerplane between and extending parallel to the first and second lateral sides. The airfoil has: a pressure side; a suction side; a leading edge; and a trailing edge. A cooling passageway system comprises: a plurality of trunks extending from respective inlets along the root inner diameter end from a leading trunk near the first axial end to a trailing trunk near the second axial end; and a plurality of outlets along the airfoil including trailing edge outlets fed by the trailing trunk. The trailing trunk has means for limiting flow separation at a turn.

A further embodiment of any of the foregoing embodiments may additionally and/or alternatively include the means being means for turning a flow forward and then rearward.

A further embodiment of any of the foregoing embodiments may additionally and/or alternatively include, viewed normal to the end-to-end centerplane, the outside of the turn protruding forward of an adjacent portion of the trunk by at least 10% of a span of the adjacent portion.

Another aspect of the disclosure involves a turbine blade comprising: an attachment root and an airfoil. The root has: an inner diameter end; a first axial end; a second axial end, a rearward direction defined from the first axial end to the second axial end; a first lateral side; and a second lateral side, an end-to-end centerplane between and extending parallel to the first and second lateral sides. The airfoil has: a pressure side; a suction side; a leading edge; and a trailing edge. A cooling passageway system comprises: a plurality of trunks extending from respective inlets along the root inner diameter end from a leading trunk near the first axial end to a trailing trunk near the second axial end; and a plurality of outlets along the airfoil including trailing edge outlets fed by the trailing trunk. Viewed normal to the end-to-end centerplane: the trailing trunk has a turn passing forward and then rearward; an outside of the turn protrudes forward the outside of the turn forms a first bump; the inside of the turn forms a second bump; and a forward extreme of the second bump is radially outboard of a forward extreme of the first bump.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
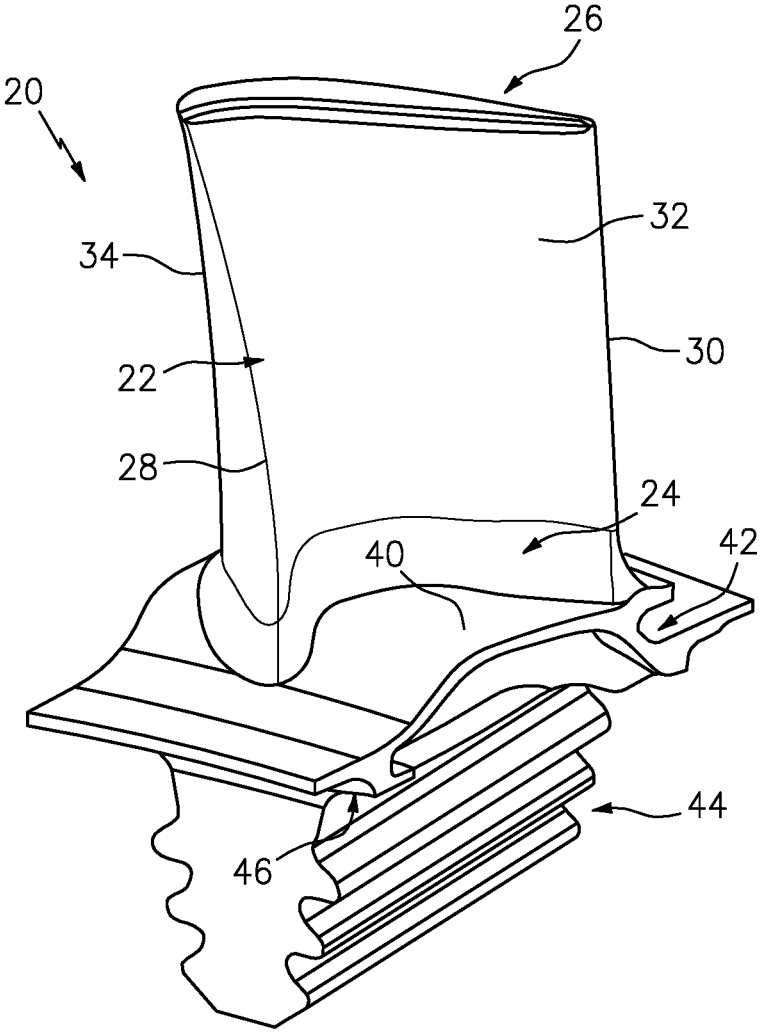
FIG. 1 is a view of a turbine blade.

In FIG. 1, an engine turbine element 20 is illustrated as a blade having an airfoil 22 which extends between an inboard end 24, and an opposing outboard end 26 (e.g., at a free tip), a distance therebetween extending substantially in the engine radial direction. The airfoil also includes a leading edge 28 and an opposing trailing edge 30. A pressure side 32 and an opposing suction side 34 extend between the leading edge 28 and trailing edge 30.

The airfoil inboard end 24 is disposed at the outboard surface 40 of a platform 42. An attachment root 44 extends radially inward from the underside 46 of the platform.

Figure 6:
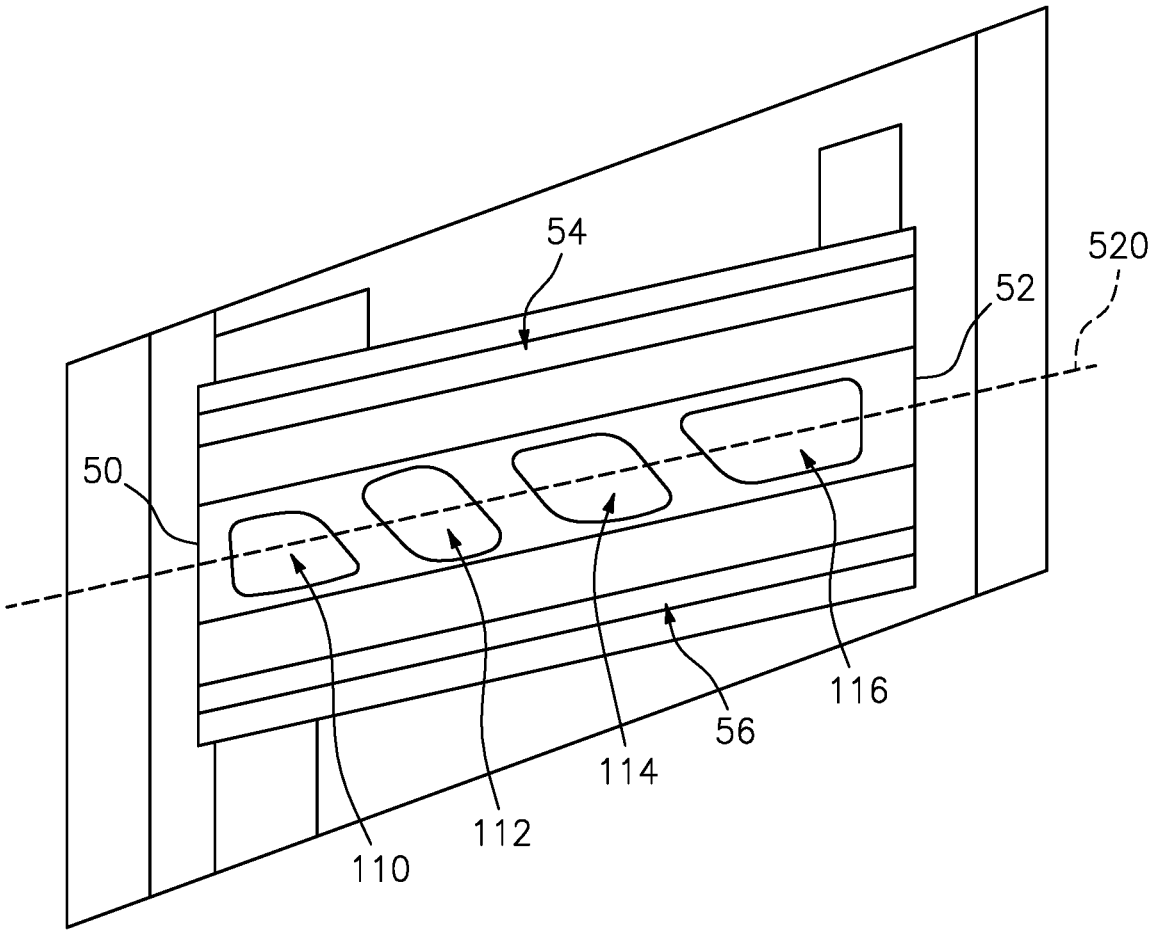
FIG. 6 is an underside or inner diameter (ID) view of the blade of FIG. 1.

The root 44 has an inner diameter (ID) end or face 48, an upstream axial end 50, a downstream axial end 52, and first and second lateral sides 54 and 56, respectively. The root 44 is complementary to a disk slot (not shown). When fully seated in the disk slot, the faces 50 and 52 may face exactly forward/upstream and rearward/downstream in the engine frame of reference. Depending on disk configuration (slot orientation), the sides may extend parallel to the engine centerline between the axial ends (root having a rectangular footprint/section) or may extend skew (root having a non-right parallelogram footprint (FIG. 6)) such as in the illustrated example.

The turbine blade is cast of a high temperature alloy, such as a Ni-based superalloy, for example, PWA 1484, which is a nickel base single crystal alloy.

The blade may also have a thermal barrier coating (TBC, e.g., one or more layer ceramic atop of one or more layer bondcoat) system along at least a portion of the airfoil. FIGS. 2-6 show further details of the blade.

Figure 2:
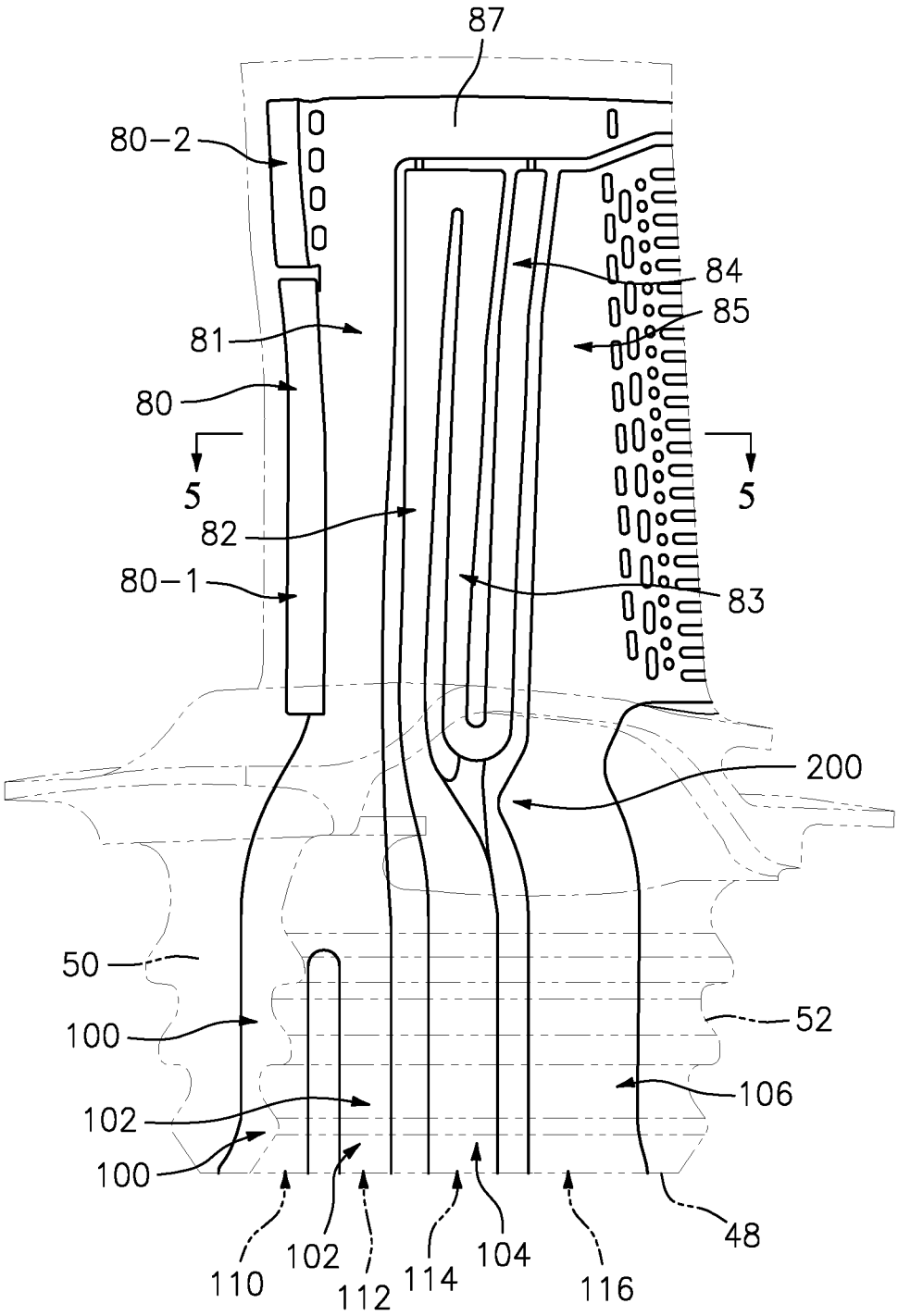
FIG. 2 is an X-ray pressure side view of the blade of FIG. 1.
Figure 5:
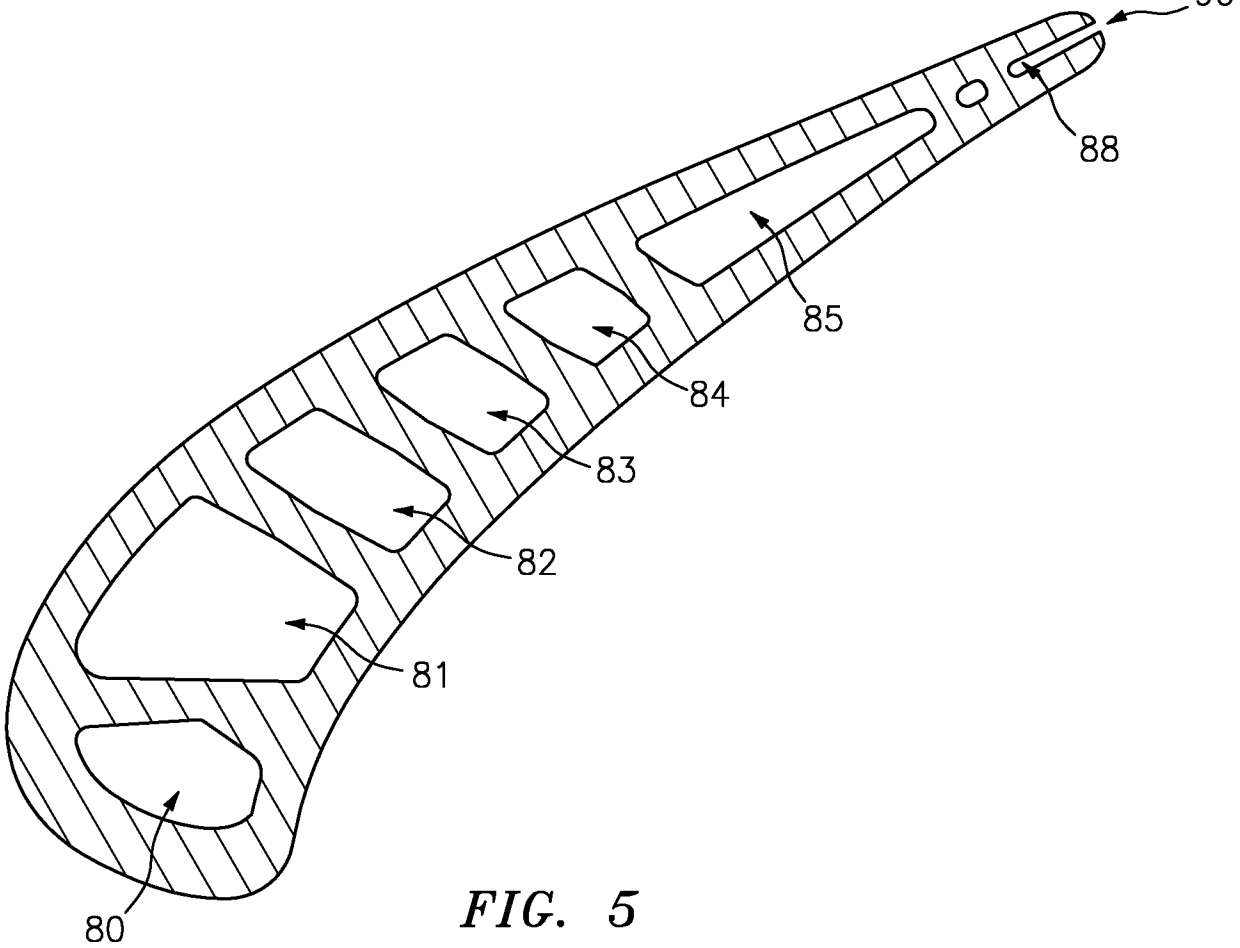
FIG. 5 is a transverse sectional view of an airfoil of the blade taken along line 5-5 of FIG. 2.

The blade has an internal cooling passageway system extending from one or more inlets along a root to a plurality of outlets (along or mostly along the airfoil and platform surfaces). FIG. 5 schematically shows spanwise passageway legs 80, 81, 82, 83, 84, and 85 from the leading edge to the trailing edge. The first leg 80 is a leading edge impingement cavity/passageway 80 having separate segments 80-1 and 80-2 (FIG. 2). The second leg 81 is an up-pass leg forming a radial feed passageway that feeds the impingement cavity 80 and a tip flag passageway 87. The third leg 82 is an up-pass leg of a second feed passageway. The fourth leg 83 is a down-pass leg of the second feed passageway. The fifth leg 84 is a second up-pass leg of the second feed passageway. The sixth leg 85 is a trailing radial feed passageway feeding a trailing edge discharge slot 88. The discharge slot extends from the trailing radial feed passageway 85 to an outlet 90 at, or near, the actual trailing edge of the blade with posts/pedestals of varying shape and distribution spanning between suction and pressure sides of the slot.

Additional outlets (e.g., cast or drilled holes, slots or other cooling features) are not shown but may be present.

The blade also includes a plurality of feed trunks 100, 102, 104, and 106 extending from respective inlets 110, 112, 114, and 116 at the inner diameter (ID) face 48 of the root. The trunks 100 and 102 merge outboard in the root to feed the leading feed passageway 81, tip flag 87, and impingement passageway 80. The trunk 104 feeds the second feed passageway. The trunk 106 feeds the passageway 85.

Spanwise arrays of impingement holes extend along impingement walls respectively separating the feed passageway leg 81 from the impingement passageway 80. Additionally, as noted above, various surface enhancements such as posts/pedestals and standoffs may be provided along the passageways to facilitate heat transfer.

Figure 10:
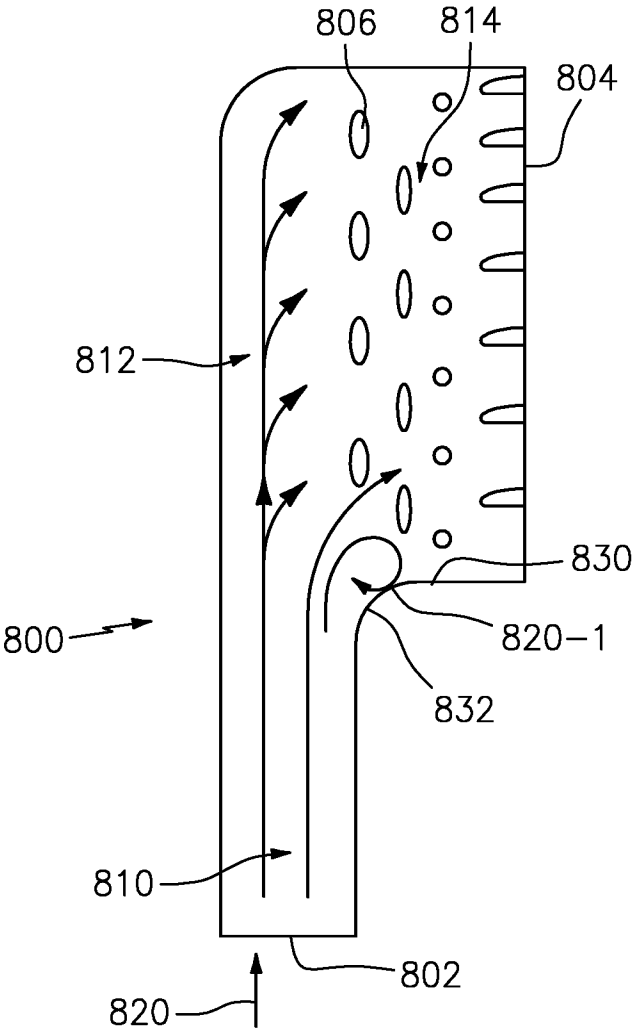
FIG. 10 (PRIOR ART)
FIG. 10 is a schematic plan view of a prior art trailing passageway.

FIG. 10 is a schematic plan view of a prior art trailing passageway 800 extending from an inlet 802 along a root ID end to outlets 804 along an airfoil trailing edge. The drawing shows various pedestals 806 in the passageway spanning between respective sides of the passageway being a suction side and a pressure side, respectively, near the airfoil suction side and pressure side. The passageway 800 effectively includes a trunk section 810 extending to a trailing edge cavity section 812 which in turn extends radially outward. A trailing edge/slot 814 extends streamwise (airfoil streamwise) downstream. A cooling flow 820 passes along a flowpath defined by the passageway 800. At the downstream end of the trunk 810 (downstream along the path of the flow 820) the flow 820 begins to make turns into the slot 814. Near the inboard (radially/spanwise) end 830 of the slot 814, the flow makes a tight turn at a turn 832 from the aft/downstream end of the cross-section of the trunk 810. This tight turn causes a recirculation or separation bubble/flow 820-1 at the turn which locally reduces cooling and reduces flow rate.

Figure 11:
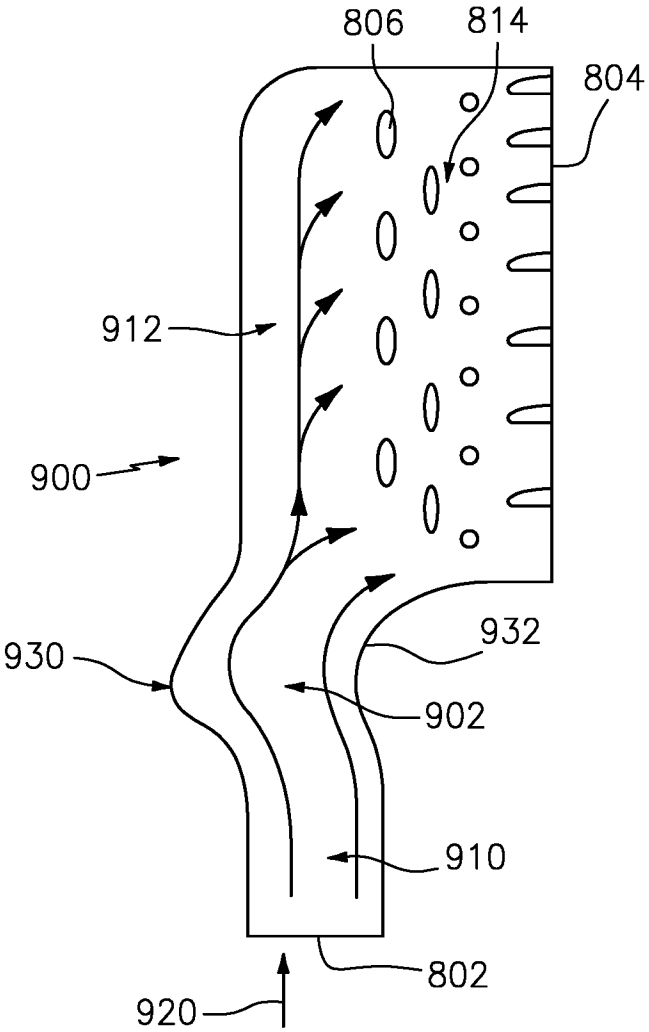
FIG. 11 is a schematic plan view of a trailing passageway modified from that of FIG. 10.

FIG. 11 shows a modified/improved passageway 900 wherein like features to the passageway 800 are numbered with like numbers. The relevant difference in this example is the addition of a dog leg turn 902 in the trunk 910 at an entrance to the cavity 912. The dog leg turn shifts the flow 920 relative to the flow 820 and better aims the flow 920 to avoid the separation. This creates a flow 920 with an added component streamwise downstream along the airfoil. Thus, at the inner diameter of the turn to the slot 814, there is a less abrupt turning of the flow 920 and less chance of separation. However, at the outer diameter of the turn, some of the flow 920 may turn slightly back forward but only relatively. This creates an outward fanning of flow between a portion turning toward the trailing edge near the ID end of the discharge slot to feed a rootward portion of the slot and a portion turning back spanwise/radially outward to feed a tipward portion of the slot 814.

Alternatively, the dog leg turn can be viewed as a series of sub turns, first turning to the left in FIG. 11 (both leading side and trailing side tuning left), then turning right along the apex (both leading side and trailing side turning right), then fanning out (trailing side continuing to turn right into the discharge slot for feeding the onboard portion of the discharge slot and leading side turning left to flow more radially for feeding outboard portions of the discharge slot).

In effect, there is a maximum diffusion angle for which flow can adequately fill the turns as the root passage expands into the main body of the trailing passageway and discharge slot. The reduction of this abrupt angle along the trailing side reduces or eliminates flow separation from the wall. At the outer diameter of the turn this concept also applies. The diffusion angle at the outer diameter of the turn is designed to be sufficiently small as to not introduce a separation zone here instead.

The turn 902 ends up locally shifting portions of the forward and aft side/edges of the trunk to create respective bumps 930, 932. As is discussed further below, the bump 930 at the forward extreme may interfit with a feature of the adjacent passageway upstream. The forward extreme of the bump 932 may be radially outboard of the forward extreme of the bump 930. This may promote the turning of flow from purely radial in trunk 910 to purely axial/circumferential as the flow enters the trailing edge cooling slot 814. For example, this relative positioning allows the flow to expand as it approaches the apexes. This slows the flow and promotes turning without separation/recirculation along the aft side/edge.

Figure 11A:
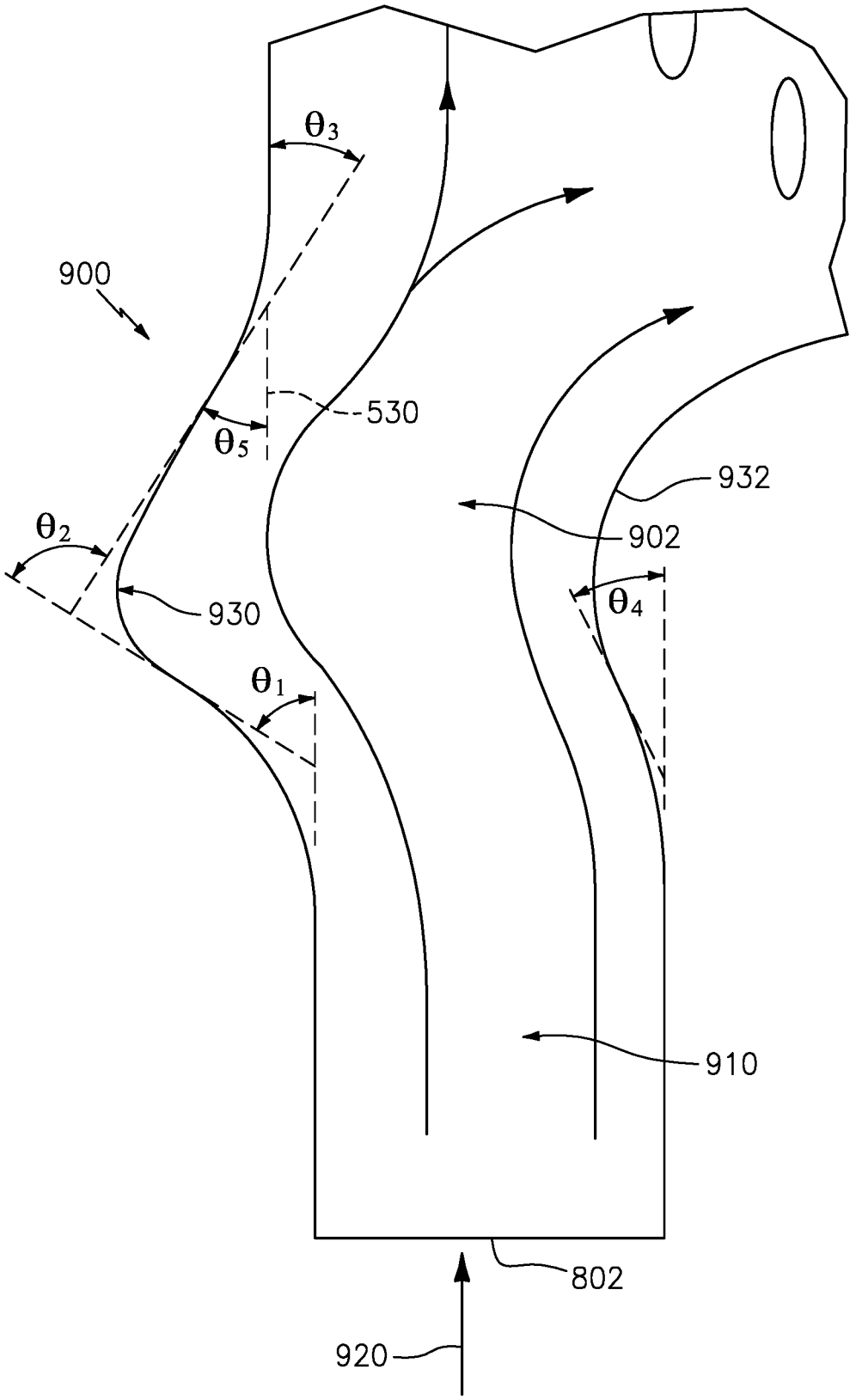
FIG. 11A is an enlarged view of a turn in the passageway of FIG. 11.

In FIG. 11A, at the front/leading side, the turn (and thus the adjacent forward flowline/streamline) initially turns forward (turns left in FIG. 11A) by an angle $\theta_1$ of at least 15°, then turns back rearward (turns right in FIG. 11A) by an angle $\theta_2$ of at least 30°, then back forward by an angle $\theta_3$ of at least 15°.

Exemplary $\theta_1$ is 15° to 60°, more particularly 25° to 60° or 30° to 55°. Exemplary $\theta_2$ is 30° to 120°, more particularly, 60° to 100° or 75° to 100°. Exemplary $\theta_3$ is 15° to 60°, more particularly 25° to 60° or 30° to 55°.

At the rear/trailing side, the turn initially turns forward by an angle $\theta_4$ of at least 15°, before turning back to form the discharge slot. Exemplary $\theta_4$ is 15° to 60°, more particularly, 25° to 50° or 25° to 40°.

FIG. 11A also shows an angle $\theta_5$ between a stacking line 530 and a tangent at the inflection point where the front/leading side begins to turn back forward (turns left in FIG. 11A) (e.g., between concave portion 226 and convex portion 227 (FIG. 2B) discussed below). Exemplary $\theta_5$ is at least 15° more particularly, 15° to 60° or 25° to 60° or 30° to 55°.

Figure 3:
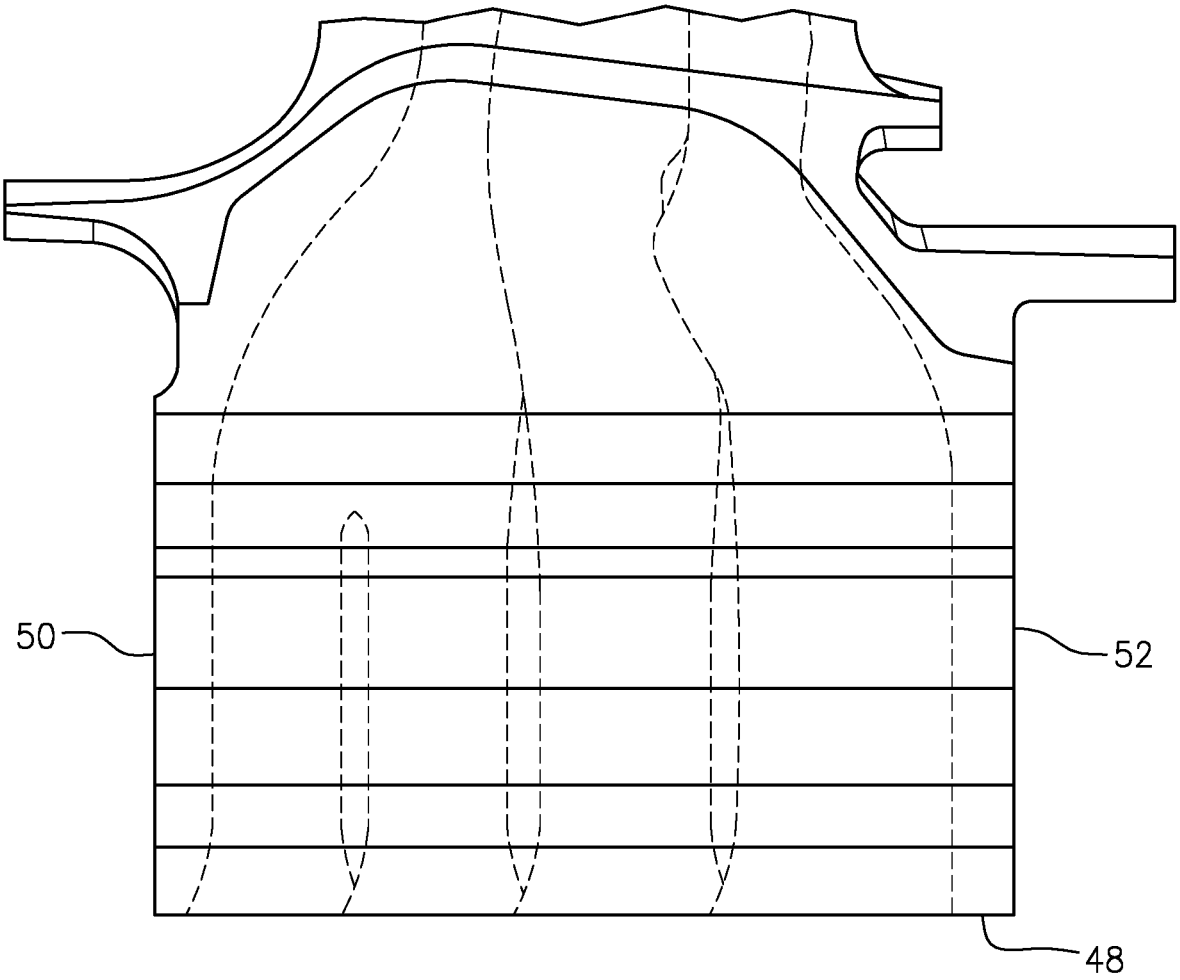
FIG. 3 is an X-ray pressure side view of a root portion of the blade of FIG. 1 viewed circumferentially relative to an installed condition.
Figure 4:
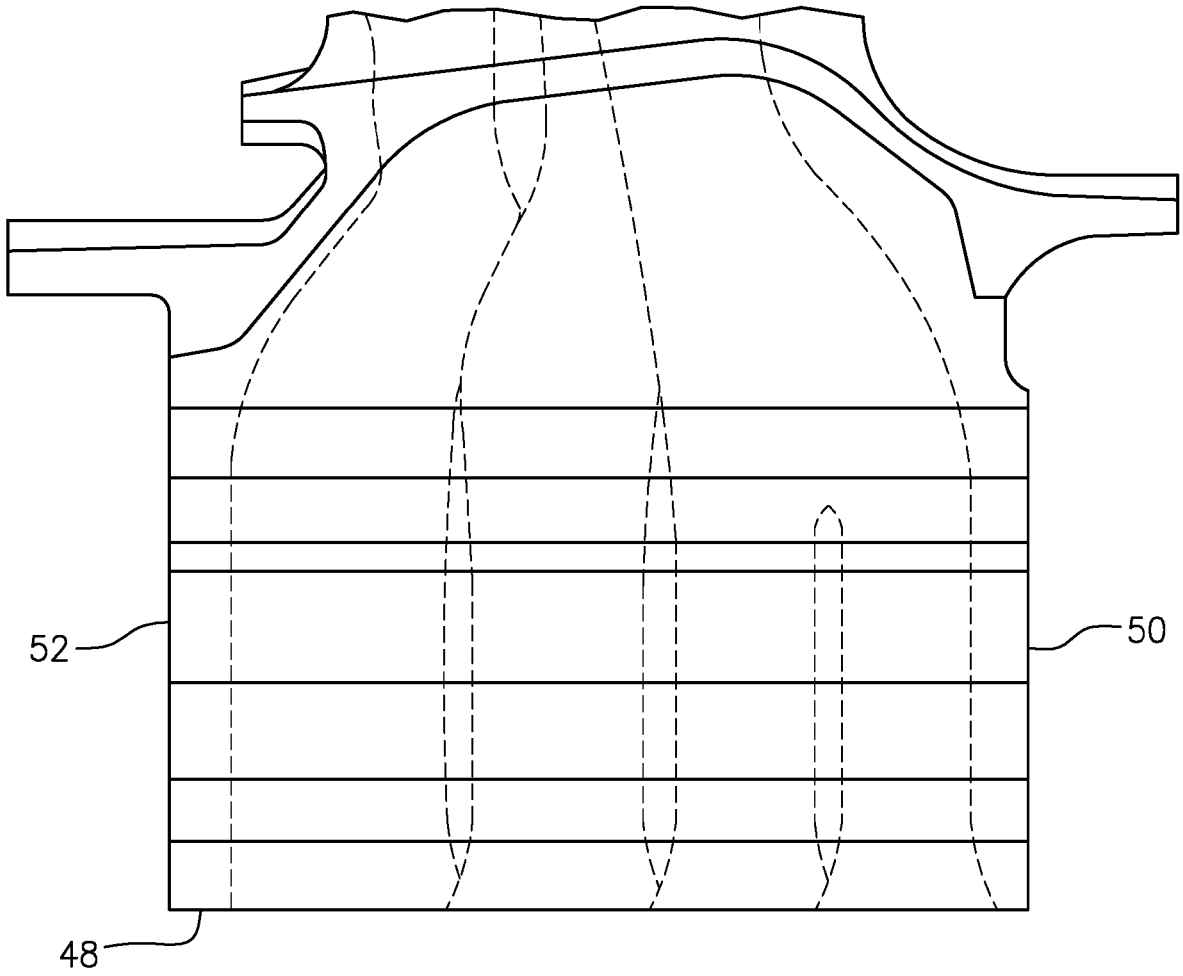
FIG. 4 is an X-ray suction side view of a root portion of the blade of FIG. 1 viewed circumferentially relative to an installed condition.

Returning to the specific example blade of FIGS. 2-6, FIG. 2 is a view orthogonal to a centerplane 520 (FIG. 6) of the root between the lateral sides 54 and 56 which also forms a centerplane of the associated disk slot. FIGS. 3 and 4 are views of the two lateral sides taken parallel to the ends. These illustrate how perspective can change the appearance of position. Thus, one may distinguish relative position between absolute front-to-back position and front-to-back viewed normal to the root/slot end-to-end centerplane.

FIG. 2 shows the trailing trunk 106 having a turn 200 formed as a dog leg or zigzag turn. An upstream (along the air flowpath through the blade rather than upstream along the core flowpath through the engine) portion 202 (FIG. 2A) of the trunk extends generally radially both along a forward side or edge 210 and a rear side or edge 212. The turn 200 has an upstream first portion 220 turning forward and a downstream second portion 222 turning rearward (not merely rearward relative to the first portion but rearward absolutely so that, at an apex 224 of the turn, the forward surface protrudes forward from both the turn upstream portion 220 and turn downstream portion 222). From the turn downstream portion 222, the flowpath and forward edge 210 may turn partially back forward (relatively) so that the forward edge 210 is more radial in a downstream cavity than along the turn downstream portion 222. Thus, inwardly, the forward side or edge along the turn 200 has a convex upstream portion 225 (FIG. 2B) transitioning to a convcave portion 226 along the turn apex 224 and to a downstream convex portion 227

A forward extreme of the forward edge 210 along the turn 200 is shown as 230 falling within the inwardly concave (outwardly convex) portion 226.

Along the rear edge 212 of the passageway, the surface also dog legs to have a forward extreme or apex 240. As with the bumps 930 and 932, the extremes 230 and 240 are of respective bumps with the rear bump's extreme 240 radially outboard of the forward bump's extreme 230. FIG. 2B also shows a radius of curvature $R_1$ at the forward edge apex 230 and $R_2$ at the rear edge apex 240. As is discussed further below, counterintuitively $R_1$ may be made tighter (smaller) than $R_2$ (normally the outside of a turn would be expected to have a greater radius of curvature).

FIG. 2 also shows a nesting of the turn 200 with the adjacent passageway immediately forward, with the adjacent passageway also having a turn 260 (at least along its rear edge/side 262) to accommodate the forward edge/side along the turn 200. In the example, the accommodation is between an upstream trunk portion 104 of the adjacent passageway and an ID turn 264 from the downpass 83 to the uppass 84.

Figure 2A:
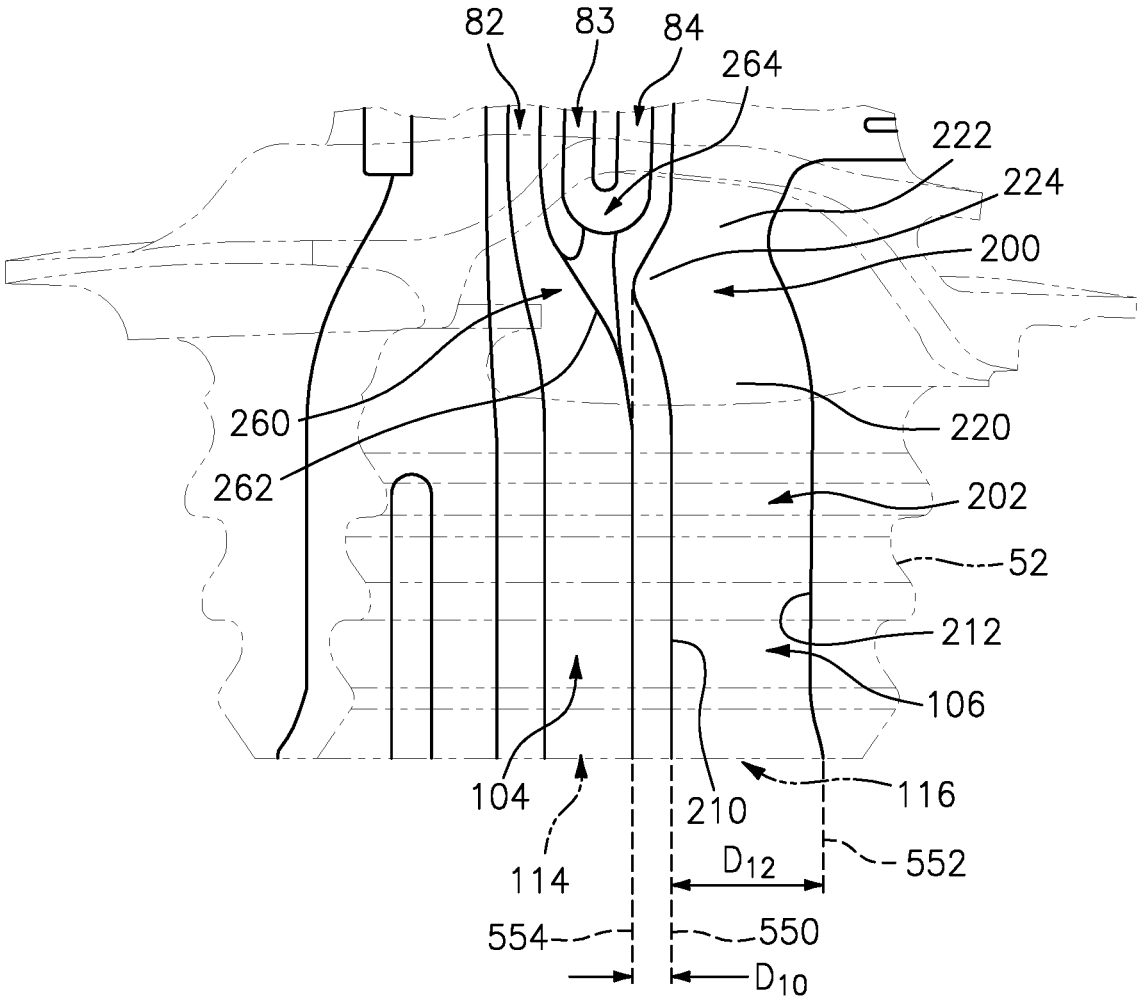
FIG. 2A is an enlarged view of a root portion of the blade of FIG. 2.
Figure 2B:
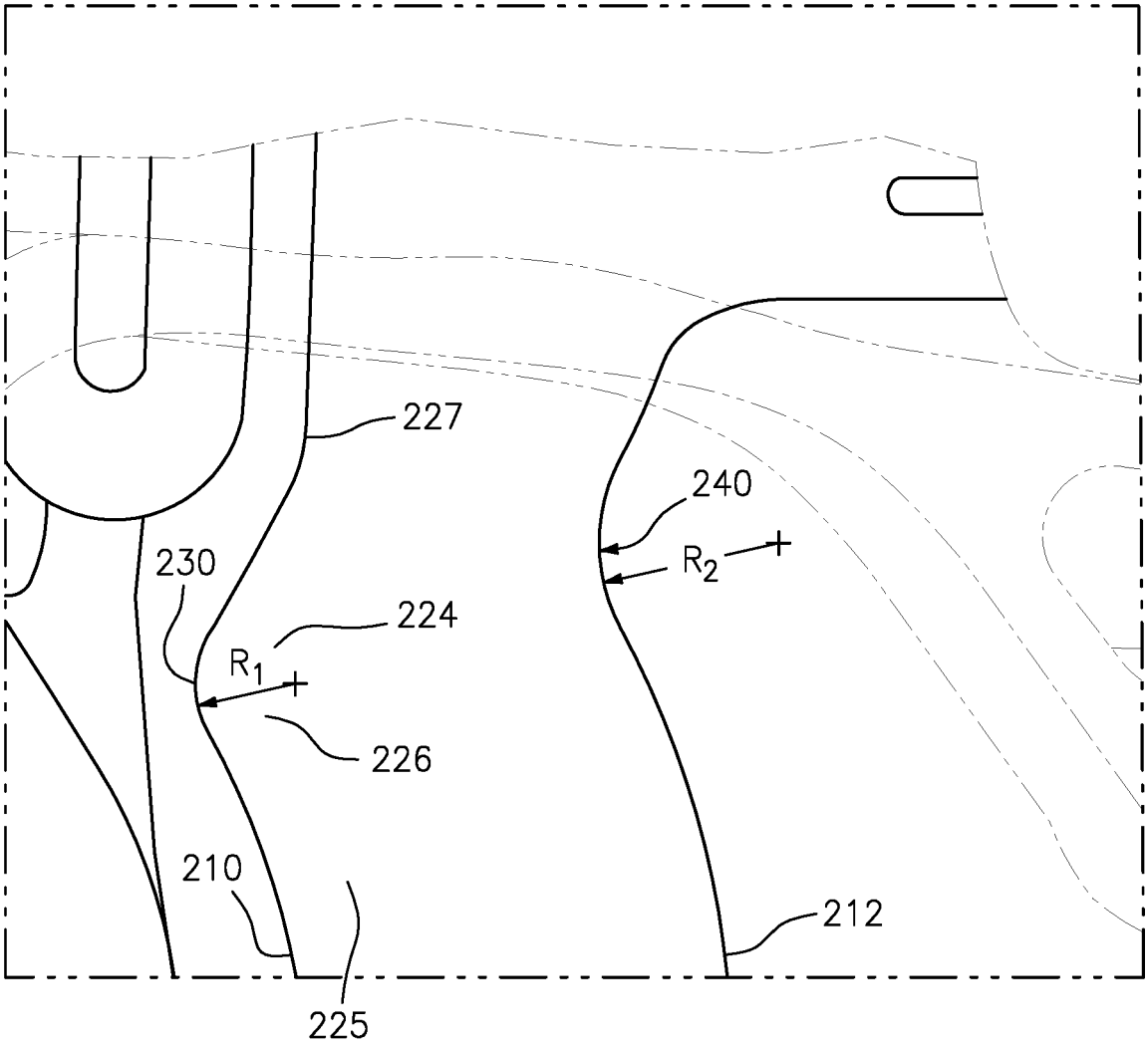
FIG. 2B is an enlarged view of a passageway turn in the blade of FIG. 2A.

FIG. 2A shows radial lines through various features including the leading side of the upstream portion 202 (line 550), trailing side of the upstream portion 202 (line 552), apex 230 (line 554), etc. An exemplary shift of the apex 230 is by an amount $D_{10}$ which is at least 10% of the local span $D_{12}$ of the passageway, or at least 20% or 10% to 100% or 20% to 100%. The shift may be great enough so that the apex 230 is forward of the upstream portion of the trailing edge/side 262 of the adjacent passageway (e.g., forward of trailing edge/side 262 along an upstream potion of trunk 104). The apex 230 may similarly be forward of an outboard portion of the adjacent passageway (in this case trailing edge/side 262 along the downstream uppass 84).

Figure 7:
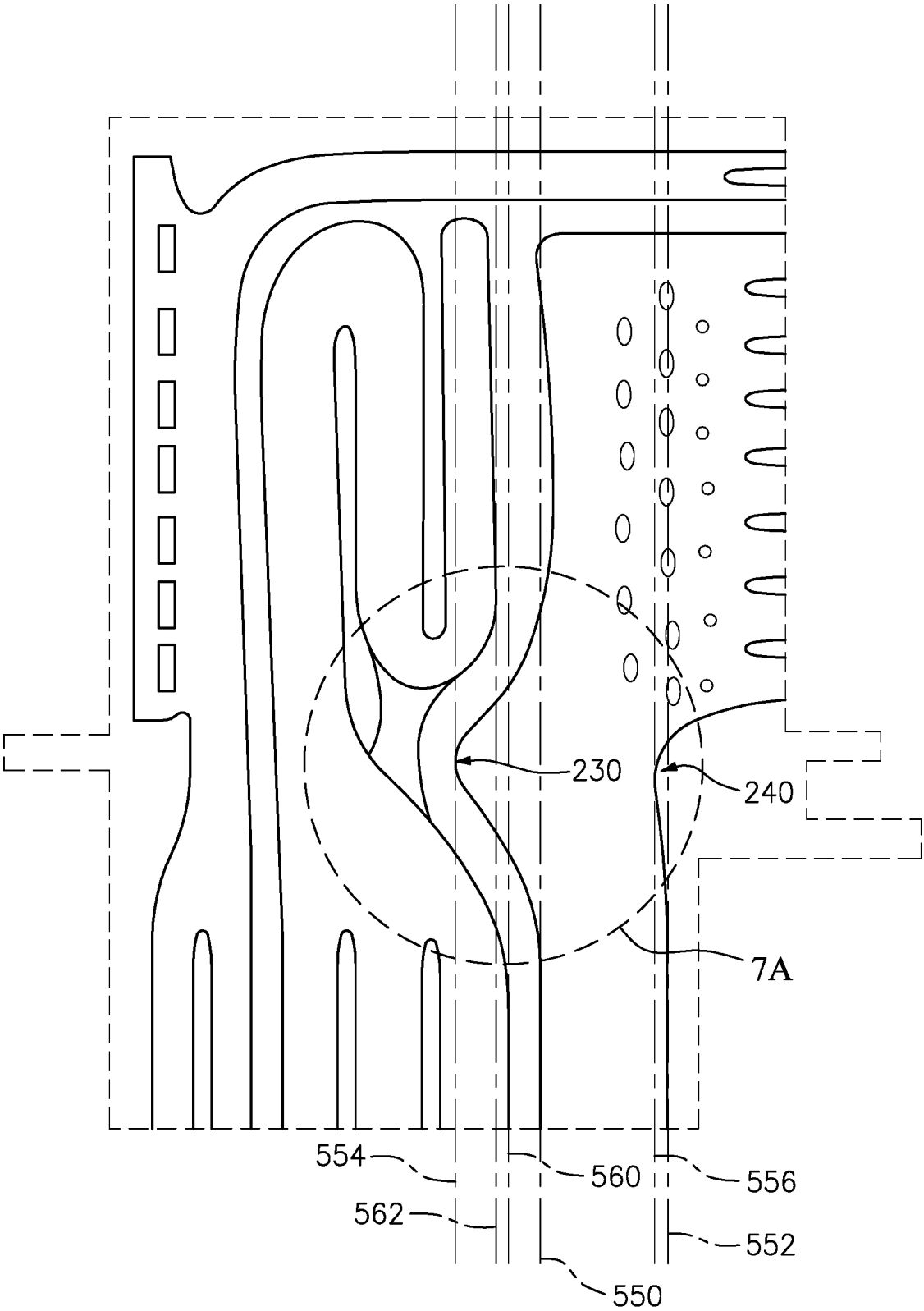
FIG. 7 is a schematicized view of a cooling passageway system of a first alternate blade.
Figure 7A:
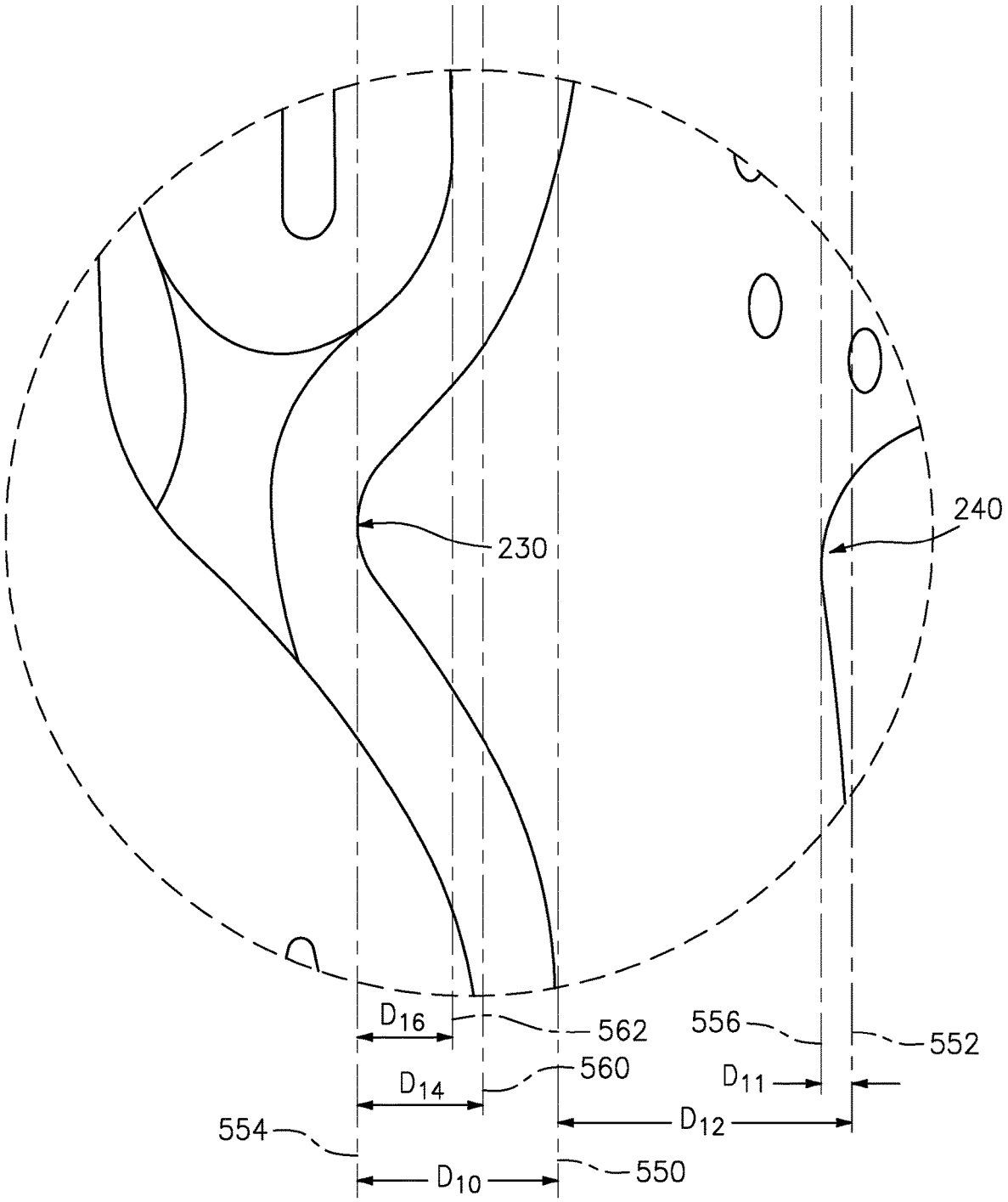
FIG. 7A is an enlarged view of a passageway turn in the blade of FIG. 7.

FIG. 7 shows a more extreme shift. FIG. 7 is a more schematized view of an alternative blade passageway system showing blade outer contour in broken lines. In addition to 550, 552, and 554, FIG. 7A labels radial lines for the apex 240 (line 556), trailing edge/side 262 along an upstream potion of trunk 104 (line 560), and trailing edge/side 262 along the downstream uppass 84 (line 562). An exemplary shift of the apex 240 is by an amount $D_{11}$ which is at least 5% of the local span $D_{12}$ of the passageway. Also the apex 230 is shown forward of line 560 by a distance $D_{14}$ and of line 562 by a distance $D_{16}$. Thus, exemplary $D_{10}$ is larger than $D_{11}$.

Figure 8:
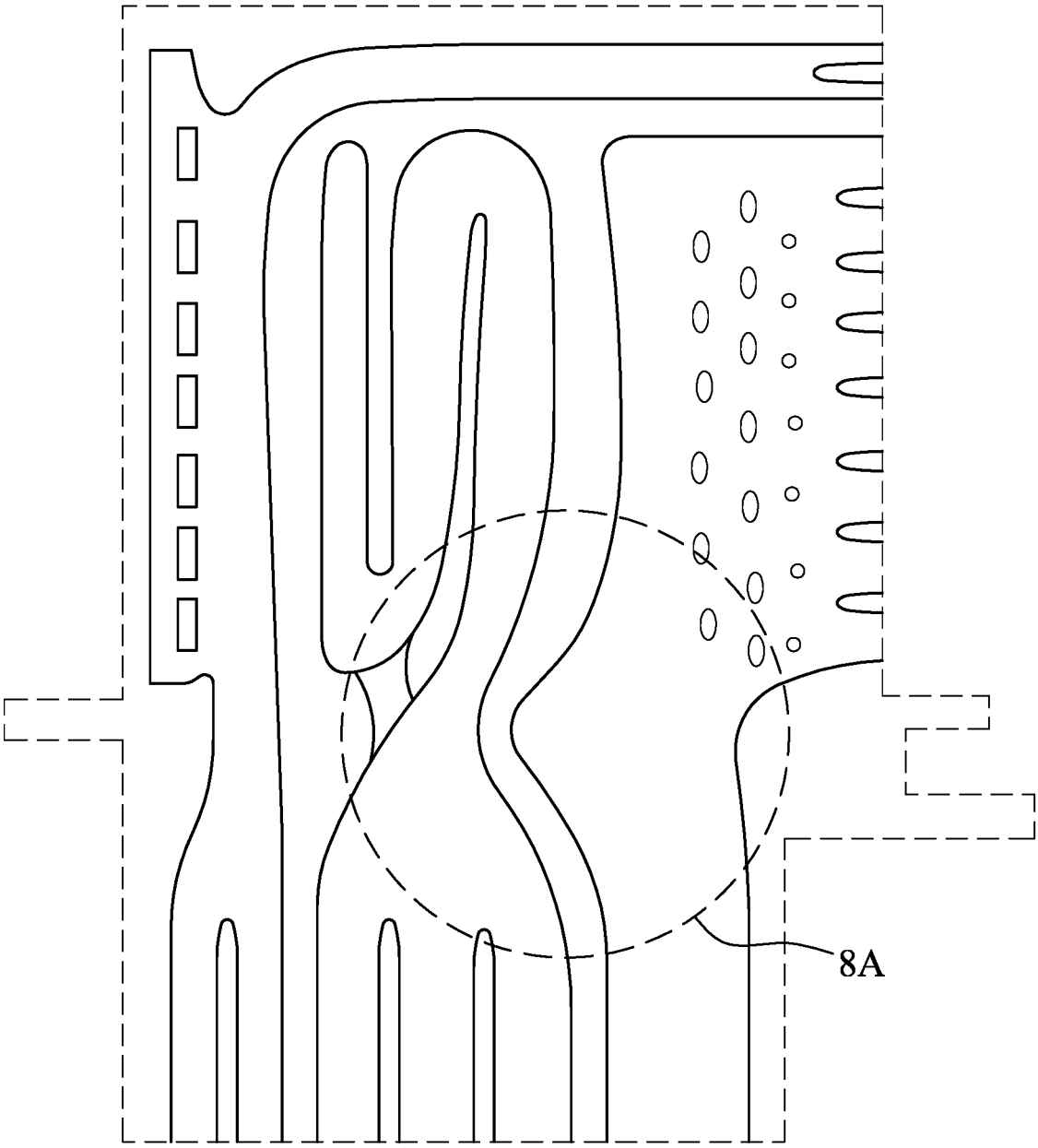
FIG. 8 is a schematicized view of a cooling passageway system of a second alternate blade.
Figure 8A:
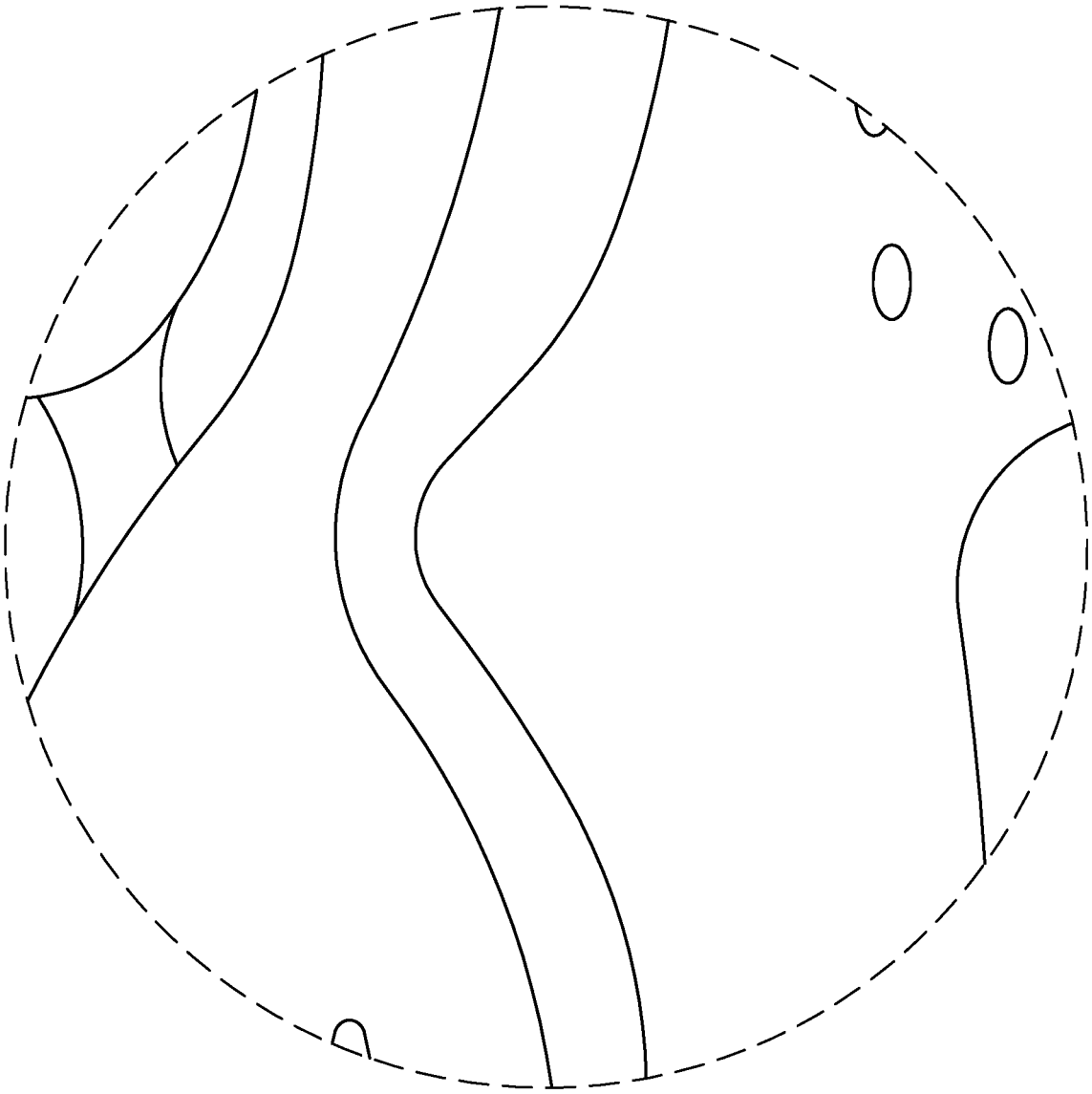
FIG. 8A is an enlarged view of a passageway turn in the blade of FIG. 8.

FIG. 8 shows an alternative blade wherein the adjacent passageway is, like FIG. 2 and FIG. 7, an uppass-downpass-uppass but wherein the progression is streamwise from downstream to upstream within the airfoil.

Figure 9:
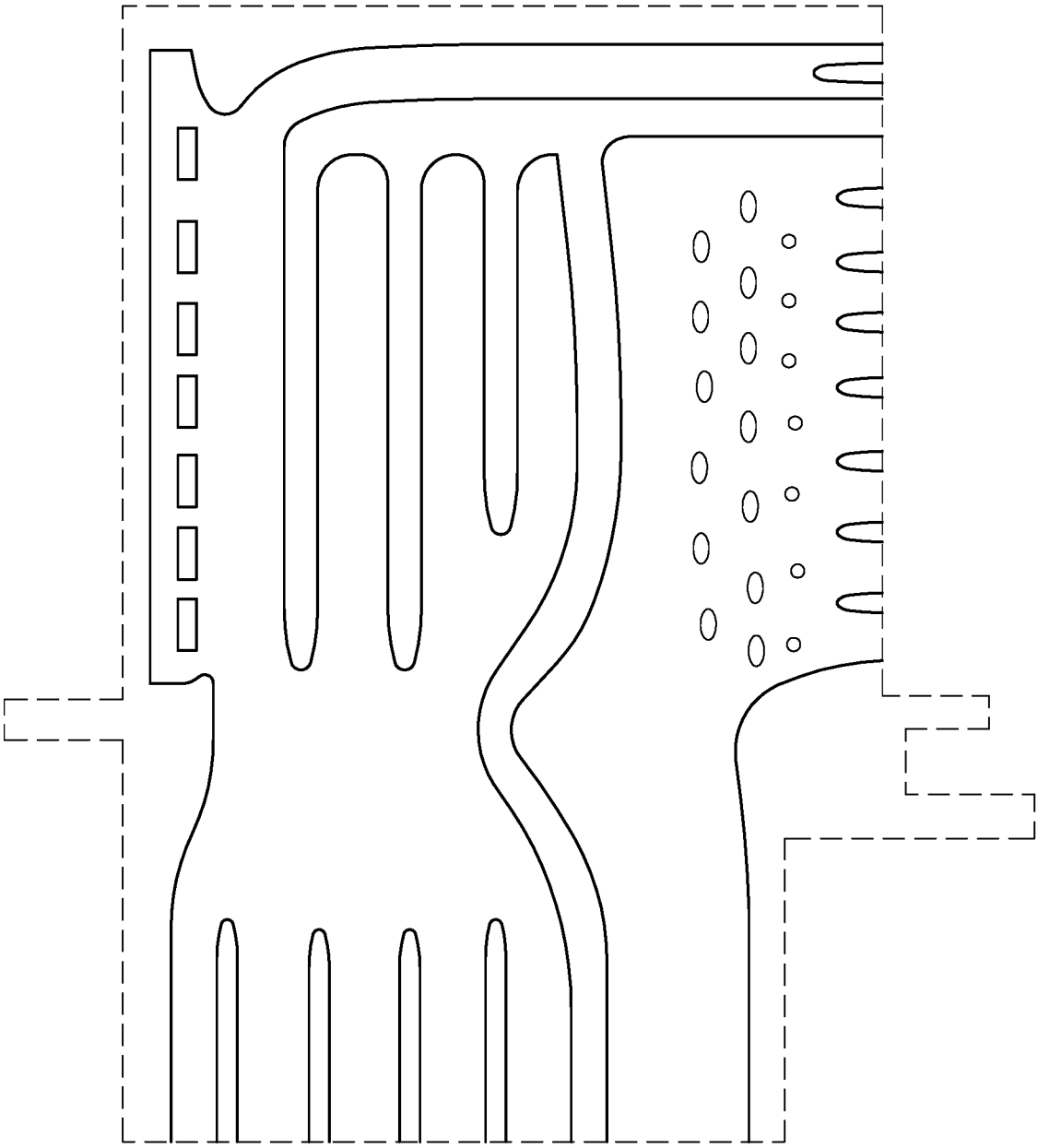
FIG. 9 is a schematicized view of a cooling passageway system of a third alternate blade.

FIG. 9 shows a yet alternative passageway system wherein the adjacent passageway is not an uppass-downpass-uppass.

Manufacture may be via conventional casting techniques (discussed above) where ceramic cores cast the trunks and adjacent passageway sections. The ceramic cores or mated metallic cores may cast the discharge slot.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A turbine blade comprising:
an attachment root having:
an inner diameter end;
a first axial end;
a second axial end, a rearward direction defined from the first axial end to the second axial end;
a first lateral side; and
a second lateral side, an end-to-end centerplane between and extending parallel to the first and second lateral sides;
an airfoil having:
a pressure side;
a suction side;
a leading edge; and
a trailing edge; and
a cooling passageway system comprising:
a plurality of trunks extending from respective inlets along the root inner diameter end from a leading trunk near the first axial end to a trailing trunk near the second axial end; and
a plurality of outlets along the airfoil including trailing edge outlets fed by the trailing trunk,
wherein viewed normal to the end-to-end centerplane:
the trailing trunk has a turn passing forward and then rearward;
an outside of the turn protrudes forward; and
the outside of the turn has a tighter curvature than an inside of the turn.

2. The turbine blade of claim 1 wherein:
the outside of the turn forms a first bump; and
the inside of the turn forms a second bump.

3. The turbine blade of claim 2 wherein:
a forward extreme of the second bump is radially outboard of a forward extreme of the first bump.

4. The turbine blade of claim 2 wherein viewed normal to the end-to-end centerplane:
the outside of the turn protrudes forward of an adjacent portion of the trunk by at least 10% of a span of the adjacent portion.

5. The turbine blade of claim 2 wherein viewed normal to the end-to-end centerplane:
a leading side of the turn including the outside of the turn has a transition from inwardly convex to inwardly concave to inwardly convex.

6. The turbine blade of claim 5 wherein:
along the inwardly concave portion of the leading side of the turn, the leading side turns by an angle $\theta_2$ of 30° to 120°.

7. The turbine blade of claim 6 wherein:
along the inwardly convex portion of the leading side of the turn radially outboard of the inwardly concave portion, the leading side turns by an angle $\theta_3$ of 30° to 55°.

8. The turbine blade of claim 2 wherein viewed normal to the end-to-end centerplane:

a trailing side of the turn has an inwardly concave portion turning by an angle $\theta_4$ of 25° to 50° before an inwardly convex transition to a discharge slot.

9. The turbine blade of claim 2 wherein viewed normal to the end-to-end centerplane:

an angle $\theta_5$ between a stacking line and a tangent at the inflection point where the leading side begins to turn back forward is at least 15°.

10. The turbine blade of claim 2 wherein:

the forward extreme of the first bump has a tighter curvature than the forward extreme of the second bump.

11. The turbine blade of claim 1 wherein viewed normal to the end-to-end centerplane:

the trailing trunk turn radially nests with a next forward one of the trunks.

12. The turbine blade of claim 11 wherein:

the next forward trunk feeds an uppass-downpass-uppass.

13. The turbine blade of claim 12 wherein viewed normal to the end-to-end centerplane:

the trailing trunk turn radially nests between the next forward one of the trunks and a turn from the downpass to the downstream uppass.

14. The turbine blade of claim 11 wherein:

the next forward trunk feeds an uppass with which the turn nests.

15. A method for using the turbine blade of claim 1, the method comprising:

passing air in through the inlets and out the outlets, wherein:

air passing along the turn avoids separation.

16. The method of claim 15 wherein:

at a downstream end of the turn, the air fans out.

17. The method of claim 15 wherein:

at a downstream end of the turn, the air fans with a forward flowline turning by an angle of 15° to 60.

18. A turbine blade comprising:

an attachment root having:

an inner diameter end;

a first axial end;

a second axial end, a rearward direction defined from the first axial end to the second axial end;

a first lateral side; and a second lateral side, an end-to-end centerplane between and extending parallel to the first and second lateral sides;

an airfoil having:

a pressure side;

a suction side;

a leading edge; and a trailing edge; and a cooling passageway system comprising:

a plurality of trunks extending from respective inlets along the root inner diameter end from a leading trunk near the first axial end to a trailing trunk near the second axial end; and a plurality of outlets along the airfoil including trailing edge outlets fed by the trailing trunk, wherein viewed normal to the end-to-end centerplane:

the trailing trunk has a turn passing forward and then rearward;

an outside of the turn protrudes forward the outside of the turn forms a first bump;

the inside of the turn forms a second bump; and a forward extreme of the second bump is radially outboard of a forward extreme of the first bump.

19. The turbine blade of claim 18 wherein viewed normal to the end-to-end centerplane:

an angle $\theta_5$ between a stacking line and a tangent at the inflection point where the leading side begins to turn back forward is at least 15°.

20. The turbine blade of claim 18 wherein viewed normal to the end-to-end centerplane:

a trailing side of the turn has an inwardly concave portion turning by an angle $\theta_4$ of 25° to 50° before an inwardly convex transition to a discharge slot.

21. A method for using the turbine blade of claim 18, the method comprising:

passing air in through the inlets and out the outlets, wherein:

air passing along the turn avoids separation;

at a downstream end of the turn, the air fans out; and at a downstream end of the turn, the air fans with a forward flowline turning by an angle of 15° to 60.

* * * * *